US006733423B1

(12) United States Patent
Chang

(10) Patent No.: US 6,733,423 B1
(45) Date of Patent: May 11, 2004

(54) SPEED CONTROL DEVICE OF A TREADMILL

(75) Inventor: Chih-Yuan Chang, Taichung Hsien (TW)

(73) Assignee: Alilife Industrial Co., Ltd., Taichiung Hsieng (TW)

( * ) Notice: Subject to any disclaimer, the term of this patent is extended or adjusted under 35 U.S.C. 154(b) by 0 days.

(21) Appl. No.: 10/372,164

(22) Filed: Feb. 25, 2003

(51) Int. Cl.[7] ..... A63B 22/00
(52) U.S. Cl. ..... 482/54; 482/51
(58) Field of Search ..... 482/51, 54

(56) References Cited

U.S. PATENT DOCUMENTS 5,800,314 A * 9/1998 Sakakibara et al. ..... 482/54
6,042,514 A * 3/2000 Abelbeck ..... 482/54
6,152,854 A * 11/2000 Carmein ..... 482/4

* cited by examiner

*Primary Examiner*—Glenn E. Richmon
(74) *Attorney, Agent, or Firm*—Rosenberg, Klein & Lee

(57) ABSTRACT

A speed control device of a treadmill includes a transmitter, a receiver, a transmitter end circuit and a receiver end circuit. The transmitter serves to generate and transmit ultrasonic wave, while the receiver serves to receive reflected ultrasonic wave. The transmitter end circuit has an oscillating IC circuit and an analog-digital converting circuit. The oscillating IC circuit serves to oscillate the ultrasonic wave generated by the transmitter to high frequency. The analog-digital converting circuit serves to convert digital signal into analog signal. The receiver end circuit has an amplifying circuit and an analog-digital converting circuit. The amplifying circuit serves to amplify the reflected ultrasonic wave received by the receiver into high frequency. The analog-digital converting circuit serves to convert the reflected analog signal into digital signal.

4 Claims, 9 Drawing Sheets

SPEED CONTROL DEVICE OF A TREADMILL

BACKGROUND OF THE INVENTION

The present invention is related to a speed control device of a treadmill. The speed control device includes an ultrasonic transmitter and an ultrasonic receiver arranged on a controlling panel of the treadmill. The ultrasonic wave transmitted by the transmitter can be truly reflected and received by the receiver so as to accurately calculate the distance of the user and control the speed of the treadmill.

Referring to FIG. 7, a conventional treadmill includes a base seat 4 and a tread platform 5. The base seat 4 has two upward extending columns 4. A panel 42 is mounted between the top ends of the columns 41 for controlling and adjusting the speed and slope of the treadmill. A front section of the tread platform 5 is mounted between the two columns 41. A tread belt 51 is circularly rotatably disposed in the tread platform 5. The panel 42 is spaced from a user by a certain distance. In treading, when the user desires to operate the treadmill, for example, slow down the speed, the user must tilt his/her body forward to get close to the panel 42 so as to operate the panel 42 for slowing down the speed. When changing the treading attitude, the original coordinated treading movement of the user will be interrupted.

Moreover, when operating the panel 42, the user must see the panel 42 to select a desired press key. However, the user is in a dynamic state, while the panel 42 is in a static state. Furthermore, the user is in a passive state. Therefore, it is hard to the user to aim at the press key of the panel 42. As a result, the user may mispress a press key. Especially when the user can hardly bear the exercise and want to stop the treadmill, the user will be unable to accurately press a correct press key of the panel 42 to stop the treadmill in time. Under such circumstance, the user may fall down. This is extremely dangerous.

In order to avoid the above situation, the treadmill is equipped with a safety device having a security rope 6. One end of the security rope 6 is fixed on the panel 42 and connected with the internal circuit. The other end of the rope 6 has a clip 61 clipping a user's body. The security rope 6 has a certain length. In case the use backs up due to insufficient strength, the security rope 6 is pulled backward to detach from the panel 42. At this time, the treadmill is powered off and stopped so as to ensure safety in use.

However the security rope 6 is connected to the user's body. Accordingly, the security rope 6 will more or less interfere with the movement of the user. In addition, in case the user forgets to use the safety device, the safety of the user cannot be ensured. Furthermore, the safety device can only stop the treadmill, while failing to control the speed thereof.

FIG. 8 shows another type of treadmill having an ultrasonic detection device. A tread platform 72 having a tread belt 71 is mounted on a bed 7. A driving device 73 is disposed at one end of the bed 7 for driving the tread belt 71. Two support columns 74 are disposed on two sides of the bed 7 and adjacent to the driving device 73. A transverse beam 75 is fixed between inner sides of the support columns 74 in a position higher than the tread belt 71. A controlling unit 8 is disposed in the middle section of the transverse beam 75. The transverse beam 75 is formed with an opening 751 facing the tread belt 71. The controlling, unit 8 includes a transmitter section, a receiver section and a timer section. The transmitter section has a pulse generator and a transmitter. The pulse generator serves to oscillate the ultrasonic wave to generate high frequency sonic speed. The transmitter transmits the ultrasonic wave to the user to detect the position of the user. The receiver section has a receiver for receiving the ultrasonic pulse reflected from the user. The timer section calculates the going and returning time of the ultrasonic wave. On the basis of the ultrasonic speed, the going and returning distance of the ultrasonic wave is calculated and sent to the controlling panel of the treadmill so as to control the speed of the tread belt. In case the user fails to bear the exercise and backs out of a set distance, the treadmill is stopped to prevent the user from falling down.

However, the controlling unit 8 of the treadmill is mounted inside the transverse beam 75. The transverse beam 75 must be first welded on the treadmill and then the transverse beam 75 is formed with the opening 751 for mounting the controlling unit 8. Then it is necessary to layout the wires to connect the controlling unit 8 with the CPU in the panel 76. Such procedures are quite complicated.

Furthermore, the controlling unit 8 of the treadmill is mounted inside the transverse beam 75 and the ultrasonic wave is transmitted to the legs of the user. When treading, the user's legs continuously alternately move. This will affect the reflection of the ultrasonic wave. Especially after reflected, the ultrasonic wave will be weakened so that the received signal will be weaker and disordered. As a result, it is hard to truly measure the distance of the user and the speed of the treadmill may be maladjusted.

Besides, the controlling, unit 8 of the treadmill is mounted inside the transverse beam 75 and positioned in a too low position. In the case a kid plays on the treadmill, the controlling Unit 8 will sense the kid to rotate the tread belt 71 of the treadmill. This will frighten the kid and even make the kid fall down.

In addition, the transverse beam 75 is positioned above the tread belt 71. When a user treads on the tread belt 71, the user's legs may incautiously hit the transverse beam 75 and get hurt. Moreover, when folding the treadmill, the transverse beam 75 will interfere with the folding of the tread platform 72 as shown in FIG. 9. As a result, the rear end of the tread platform 72 can be hardly folded to firmly lean on the bed 7.

Therefore, it is necessary to provide a measure for more accurately detecting the distance of a user and simplifying the manufacturing procedure of the treadmill without interfering with the operation thereof.

SUMMARY OF THE INVENTION

It is therefore a primary object of the present invention to provide a speed control device of a treadmill. The speed control device is arranged in a certain position on a controlling panel of the treadmill. The speed control device includes a transmitter, a receiver, a transmitter end circuit and a receiver end circuit. The transmitter and the receiver are mounted on the control ling panel of the treadmill and directed to rear end of the treadmill. The transmitter serves to generate and transmit ultrasonic wave, while the receiver serves to receive reflected ultrasonic wave. The transmitter end circuit is disposed in the controlling panel and connected with a CPU and the transmitter inside the controlling panel. The transmitter end circuit has an oscillating IC circuit and an analog-digital converting circuit. The oscillating IC circuit serves to oscillate the ultrasonic wave generated by the transmitter to high frequency. The analog-digital converting circuit serves to convert the digital signal of the CPU into analog signal, The receiver end circuit is disposed in the controlling panel and connected with the CPU and the receiver inside the controlling panel. The receiver end circuit has an amplifying circuit and an analog-digital converting circuit. The amplifying circuit serves to amplify the reflected ultrasonic wave received by the receiver into high frequency. The analog-digital converting circuit serves to convert the reflected analog signal into digital signal and send the signal to the CPU. The transmitter and the receiver of the controlling device are arranged on the controlling panel of the treadmill that is positioned at a height substantially equal to the height of upper half of a user's body. Therefore, the transmitted ultrasonic wave is reflected by the upper half of the user's body to be received by the receiver. Accordingly, the distance of the user can be accurately detected by way of ultrasonic wave and thus the CPU of the controlling panel can truly control the speed of the treadmill.

It is a further object of the present invention to provide the above speed control device in which the transmitter and the receiver are pivotally connected with a seat body. Therefore, the transmission and receiving angles of the transmitter and the receiver can be adjusted in accordance with different heights of users. Therefore, the transmitter and the receiver can truly detect the user. In addition, the transmitter and the receiver have a certain pivot angle range so that the transmission and receiving of the transmitter and the receiver are limited to a certain height. Accordingly, a kid will not misactivate the treadmill.

It is still a further object of the present invention to provide the above speed control device in which the controlling device is arranged on the controlling panel of the treadmill without procedures of welding, perforation and layout of wire. Therefore, the manufacturing and processing time and labor are reduced. Also, the controlling device is mounted in such a position as not to interfere with the treading movement of the user and the folding operation of the tread platform.

The present invention can be best understood through the following description and accompanying drawings wherein:

Figure 1:
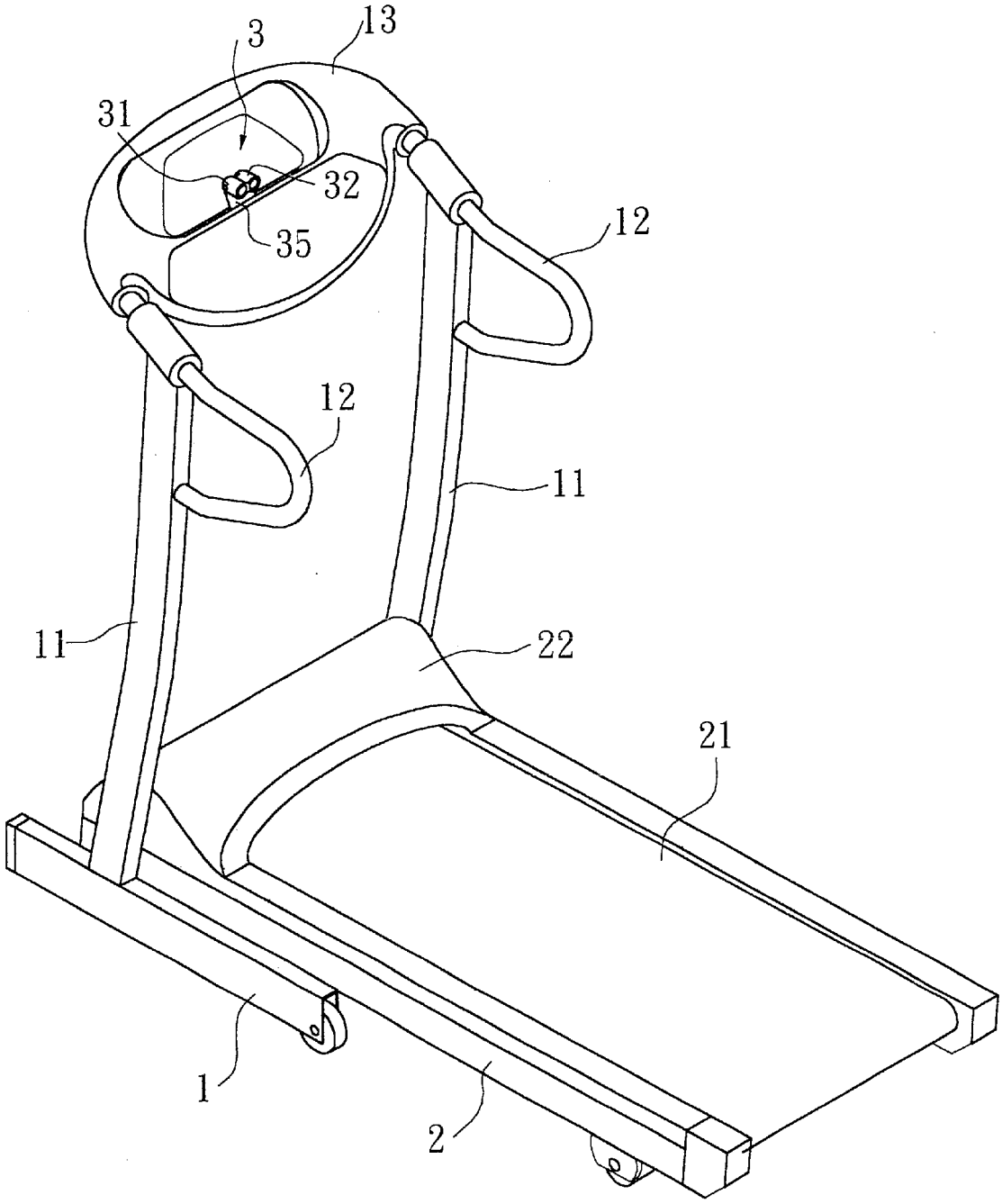
FIG. 1 is a perspective view of the present invention.
Figure 2:
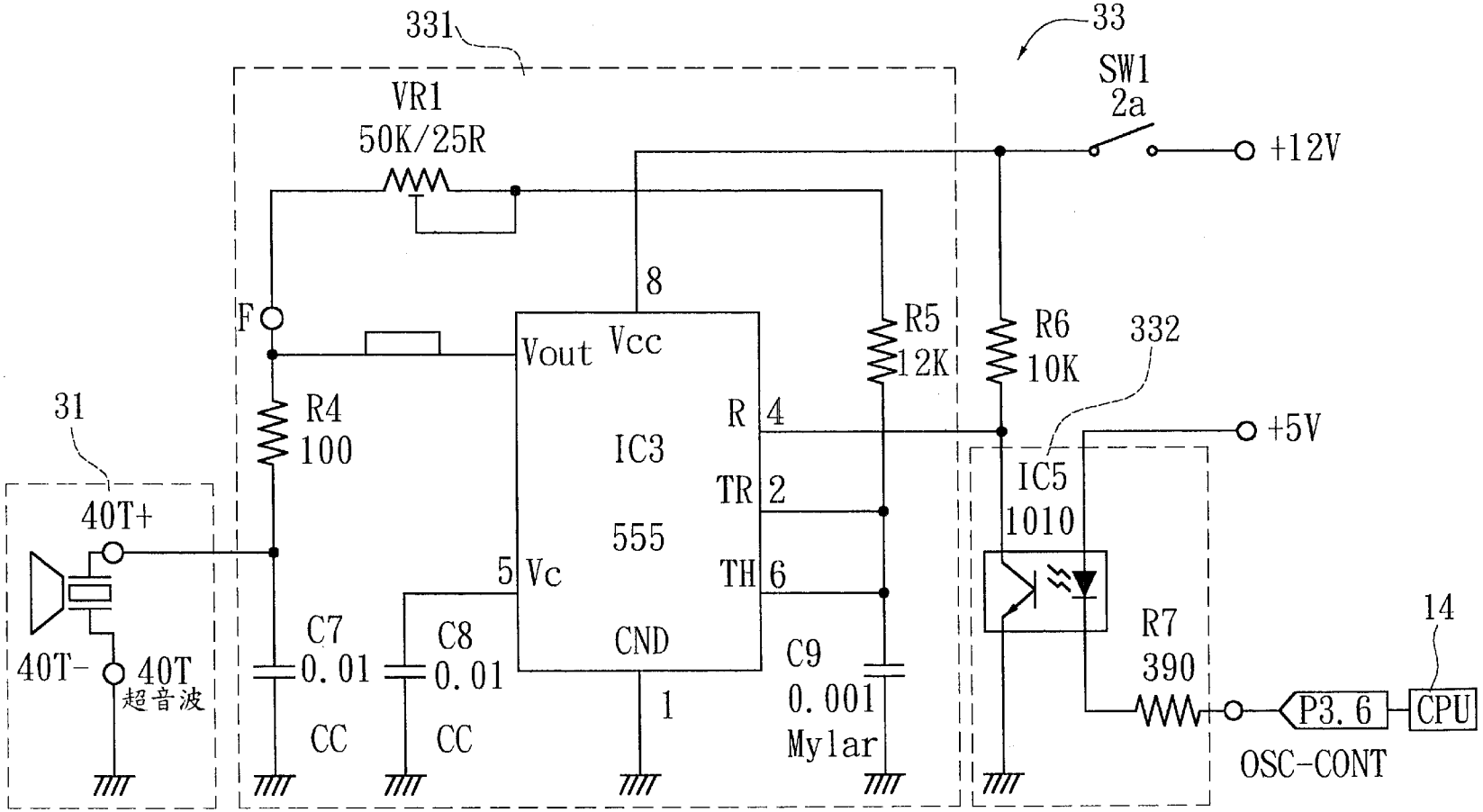
FIG. 2 is a circuit diagram of the transmitter end circuit of the present invention.
Figure 3:
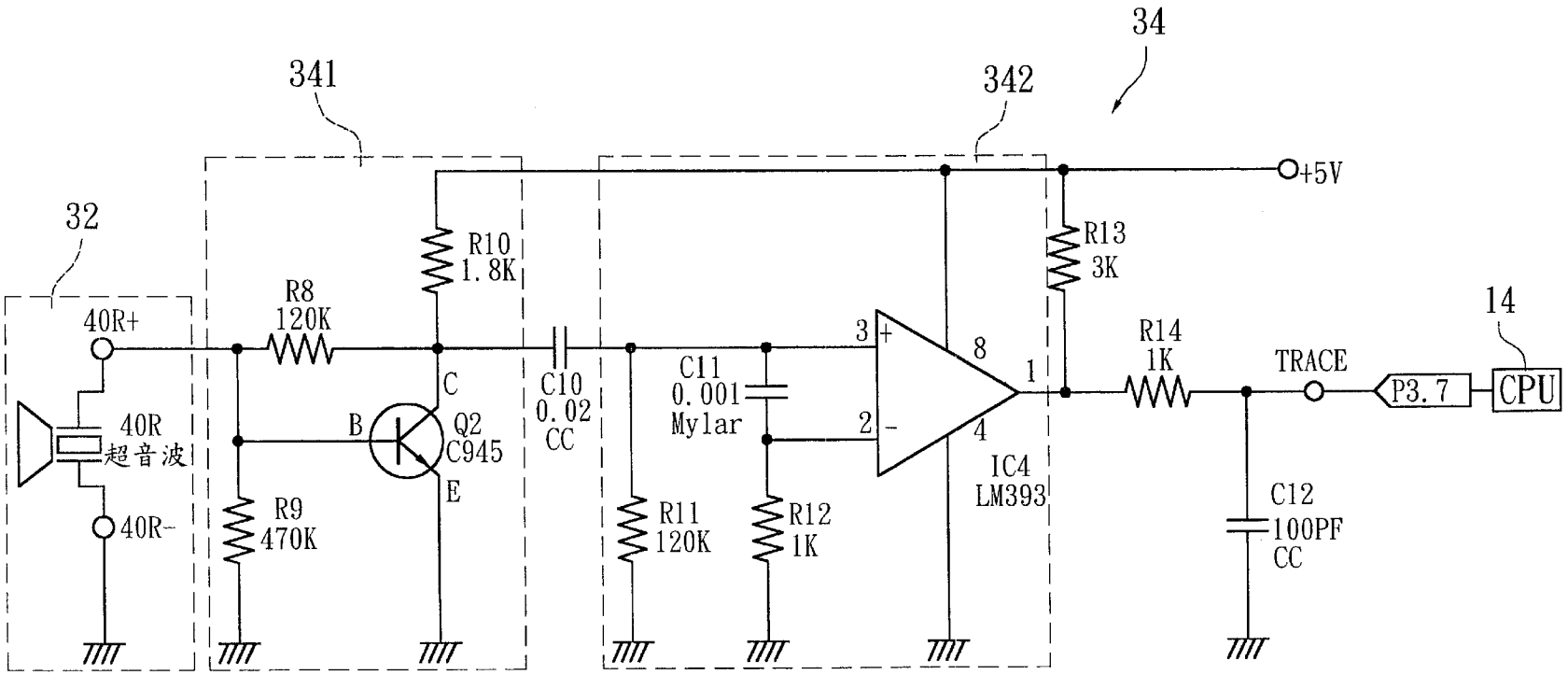
Figure 4:
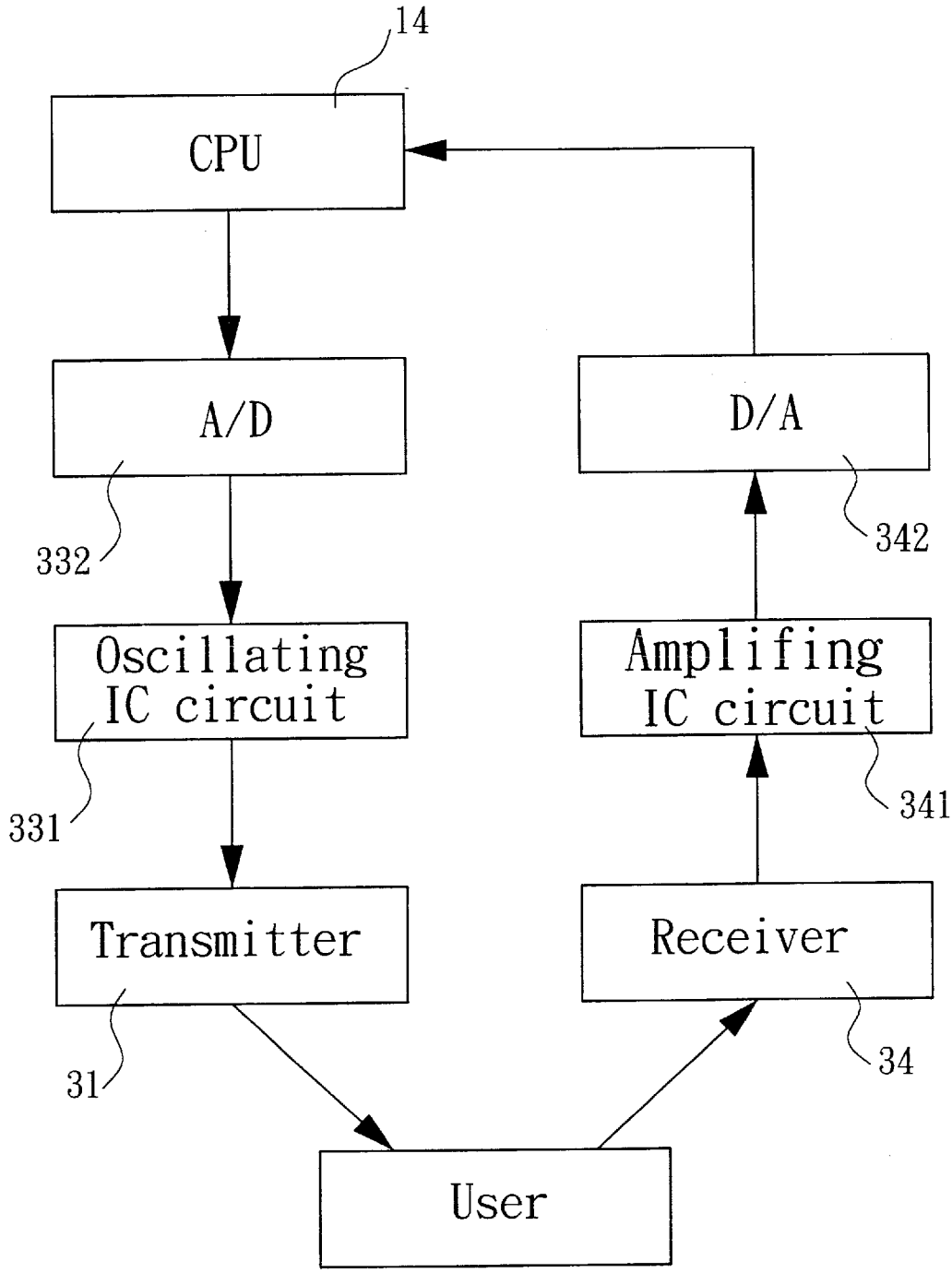
Figure 5:
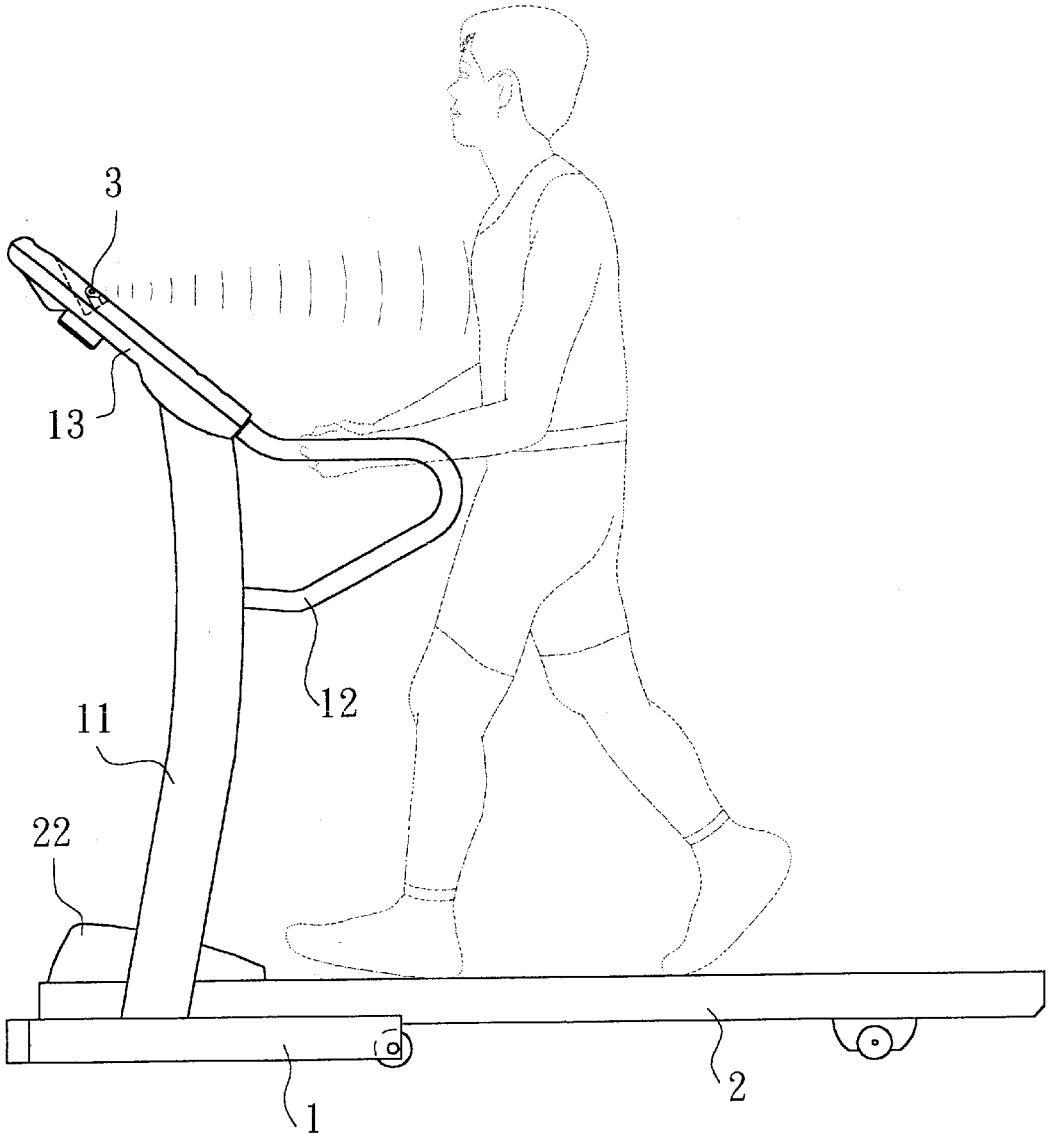
Figure 6:
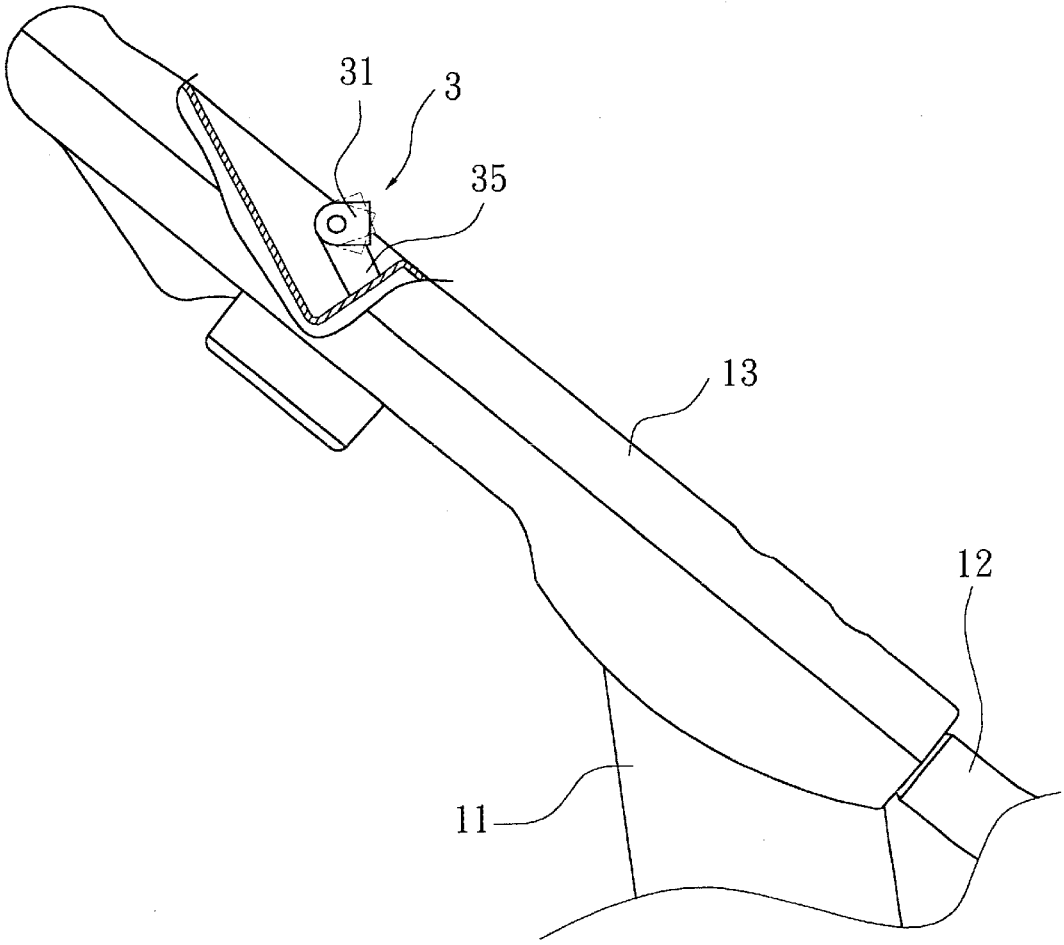
Figure 7:
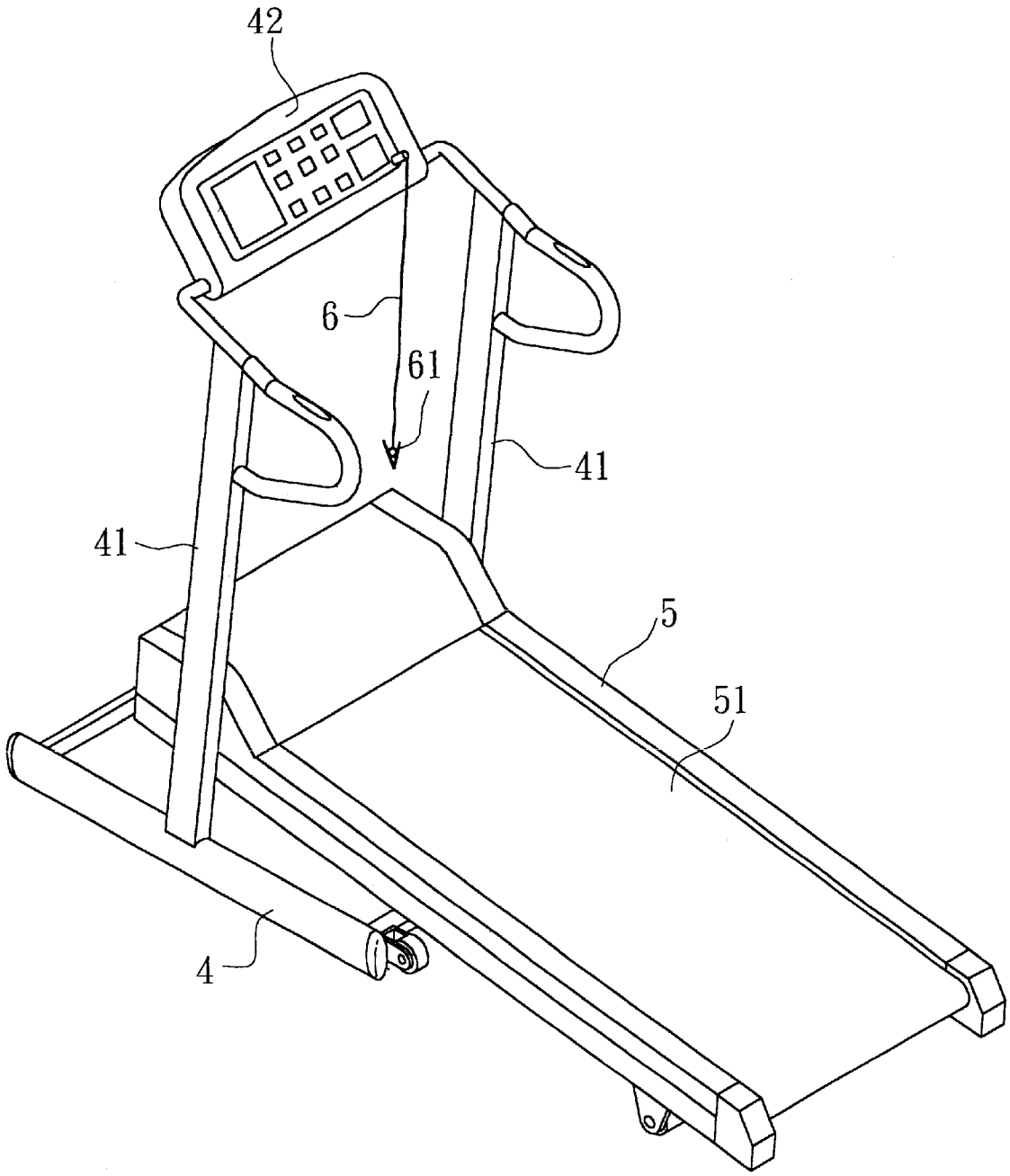
FIG. 7 PRIOR ART
Figure 8:
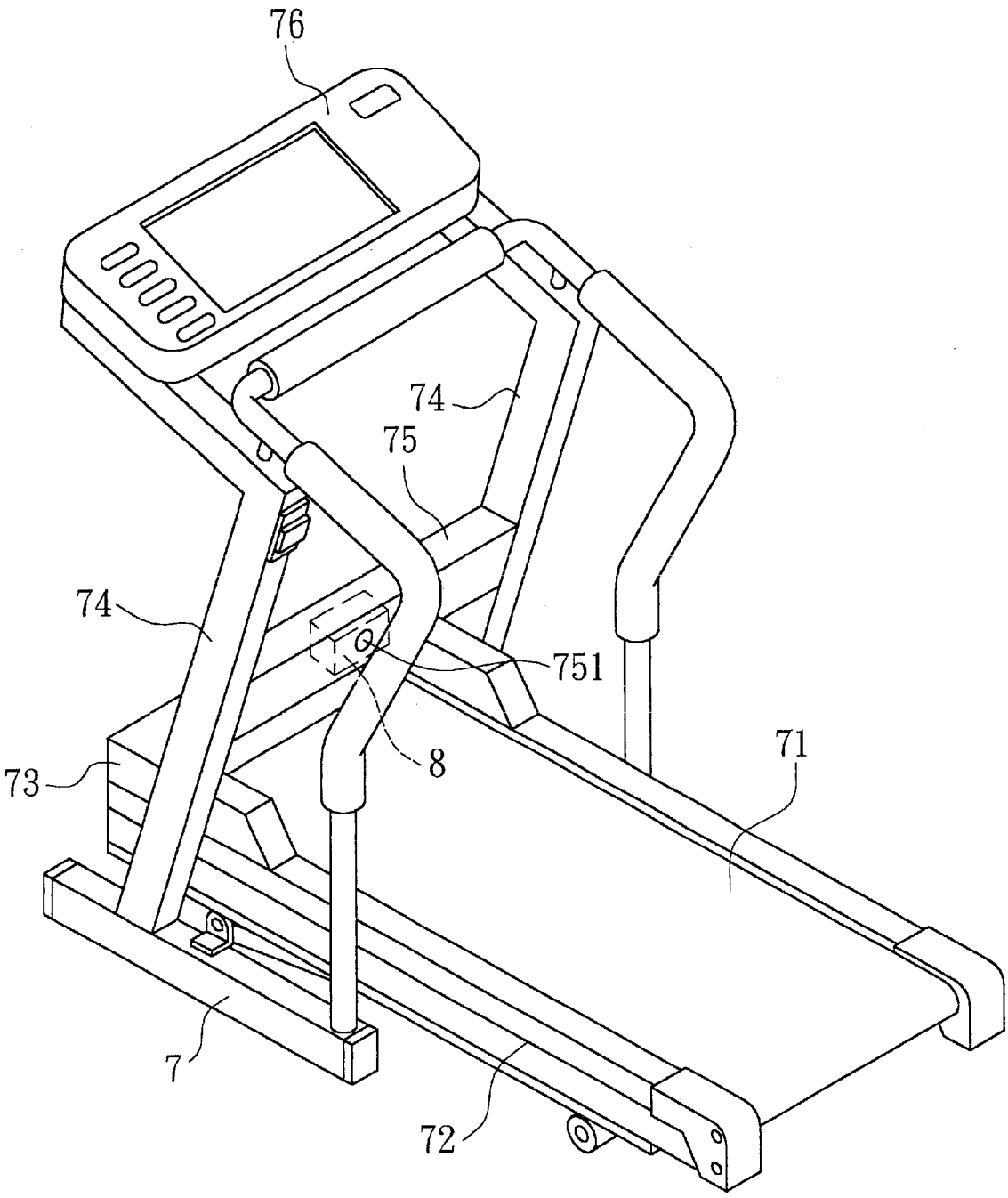
FIG. 8 PRIOR ART
Figure 9:
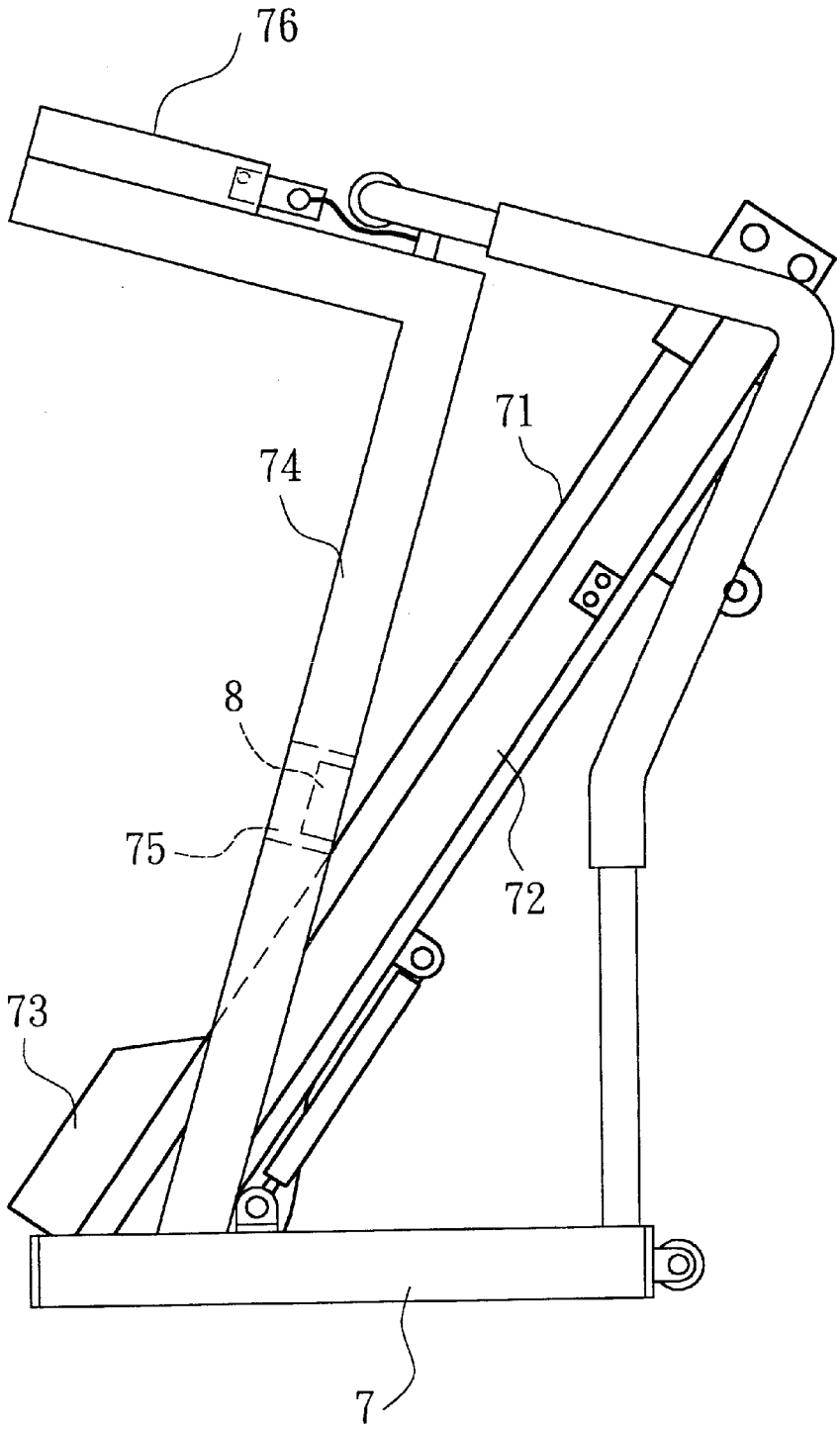
FIG. 9 PRIOR ART

FIG. .3 is a circuit diagram of the receiver end circuit of the present invention;

FIG. 4 is a flow chart of the operation of the controlling device of the present invention;

FIG. 5 shows the use of the present invention;

FIG. 6 shows the pivot angle of the transmitter and receiver of the present invention;

FIG. 7 is a perspective view of a conventional treadmill;

FIG. 8 is a perspective view of another type of conventional treadmill equipped with an ultrasonic detection device; and FIG. 9 is a side view according to FIG. 8, showing that the conventional treadmill cannot be folded.

DETAILED DESCRIPTION OF THE PREFERRED EMBODIMENT

Please refer to FIGS. 1 to 5. The present invention is related to a speed control device of a treadmill including a base seat 1, a tread platform 2 and a controlling device 3.

Two upward extending columns 11 are respectively disposed on two sides of the base seat 1. A handle 12 is disposed at top end of each column 11. A controlling panel 13 is mounted between the two handles 12. A CPU 14 is installed in the controlling panel 13 for controlling and adjusting the treading speed and slope of the treadmill.

The front end of the tread platform 2 is mounted between the two columns 11 of the base seat 1. A tread belt 21 is disposed in the tread platform 2. The tread belt 21 is driven by a motor 22 to circularly rotate.

The controlling device 3 includes a transmitter 31, a receiver 32, a transmitter end circuit 33 and a receiver end circuit 34. The transmitter 31 and the receiver 32 are mounted on the controlling panel 13 of the treadmill and directed to rear end of the treadmill. The transmitter 31 and the receiver 32 are pivotally connected with a seat body 35 fixed on the middle: of the controlling panel 13. The transmitter 31 serves to generate and transmit ultrasonic wave, while the receiver 32 serves to receive the reflected ultrasonic wave.

The transmitter end circuit 33 is disposed in the controlling panel 13 and connected with the CPU 14 and the transmitter 31 inside the controlling, panel 13. The transmitter end circuit 33 has an oscillating IC circuit 331 and an analog,-digital converting circuit 332. The oscillating IC circuit 331 serves to oscillate the ultrasonic wave generated by the transmitter 31 to 40 KHz frequency. The analog-digital converting circuit 332 serves to convert the digital signal of the CPU 14 into analog signal.

The receiver end circuit 34 is disposed in the controlling panel 13 and corrected with the CPU 14 and the receiver 32 inside the controlling panel 13. The receiver end circuit 34 has an amplifying circuit 341 and an analog-digital converting circuit 342. The amplifying circuit 341 serves to amplify the reflected ultrasonic wave received by the receiver 32 into 40 KHz frequency. The analog-digital converting circuit 342 serves to convert the reflected analog signal into digital signal and send the signal to the CPU 14.

Accordingly, when activating the CPU 14, the CPU 14 will generate a digital signal to the transmitter end circuit 33. The analog-digital converting circuit 332 of the transmitter end circuit 33 will convert the digital signal into an analog signal to the oscillating IC circuit 331. The oscillating IC circuit 331 oscillates the ultrasonic wave generated by the transmitter 31 to 40 KHz frequency. Then the transmitter 31 transmits the ultrasonic wave. When the ultrasonic wave encounters the user and is reflected back to the receiver 32, the amplifying circuit 341 of the receiver end circuit 34 amplifies the reflected weaker ultrasonic wave received by the receiver 32 into 40 KHz frequency. Then the analog-digital converting circuit 342 converts the reflected analog signal into digital signal and sends the signal to the CPU 14. The CPU 14 calculates the time period between the transmission and receiving of the ultrasonic wave and transfers the time into the distance. Accordingly, the distance between the user and the controlling panel 13 can be obtained so as to control the power source 22 of the tread platform 2 to gradually accelerate or decelerate the tread belt.

In addition, the controlling device 3 can be set with front, middle and rear distances from the user. When the user treads by middle distance, the controlling device 3 can control the tread belt 21 to keep a fixed speed. When the user treads in a faster speed to exceed the front distance, the controlling device 3 controls and gradually increases the speed of the tread belt 21 in accordance with the treading speed of the user. Ii the case that the user backs up and exceeds the rear distance due to insufficient strength, the controlling device 3 controls and gradually decreases the speed of the tread belt 21 or even stops the tread belt 21 so as to ensure safety of the user.

The transmitter 31 and the receiver 32 of the controlling device 3 are arranged on the controlling panel 13 of the treadmill that is positioned at a height substantially equal to the height of upper half of the user's body. Therefore, the transmitted ultrasonic wave is reflected by the upper half of the user's body to be received by the receiver. Accordingly, the distance of the user can be accurately detected by way of ultrasonic wave and thus the CPU 14 of the controlling panel 13 can truly control the speed of the treadmill.

Furthermore e, the transmitter 31 and the receiver 32 of the controlling device 3 are pivotally connected with the seat body 35 as shown in FIG. 6. Therefore, the transmission and receiving angles of the transmitter 31 and the receiver 32 can be adjusted in accordance with different heights of users. Therefore, the transmitter 31 and the receiver 32 can truly detect the user. In addition, the transmitter 31 and the receiver 32 have a certain pivot angle range so that the transmission and receiving of the transmitter 31 and the receiver 32 are limited to a certain height. Accordingly, a kid will not misactivate the treadmill.

Besides, the controlling device 3 is arranged on the controlling panel 13 of the treadmill without procedures of welding, perforation and layout of wire. Therefore, the manufacturing and processing time and labor are reduced. Also, the controlling device 3 is mounted in such a position as not to interfere with the treading movement of the user and the folding operation of the tread platform 2.

The above embodiment is only used to illustrate the present invention, not intended to limit the scope thereof. Many modifications of the above embodiment can be made without departing from the spirit of the present invention.

What is claimed is:

1. A speed control device of a treadmill, said speed control device being arranged in a certain position on a controlling panel of the treadmill, said speed control device comprising a transmitter, a receiver, a transmitter end circuit and a receiver end circuit, wherein:

the transmitter and the receiver are mounted on the controlling panel of the treadmill and directed to rear end of the treadmill, the transmitter serving to generate and transmit ultrasonic wave, while the receiver serving to receive reflected ultrasonic wave;

the transmitter end circuit is disposed in the controlling panel and connected with a CPU and the transmitter inside the controlling panel, the transmitter end circuit having an oscillating IC circuit and an analog-digital converting circuit, the oscillating IC circuit serving to oscillate the ultrasonic wave generated by the transmitter to high frequency, the analog-digital converting circuit serving to convert the digital signal of the CPU into analog signal; and the receiver end circuit is disposed in the controlling panel and connected with the CPU and the receiver inside the controlling panel, the receiver end circuit having an amplifying circuit and an analog-digital converting circuit, the amplifying circuit serving to amplify the reflected ultrasonic wave received by the receiver into high frequency, the analog-digital converting circuit serving to convert the reflected analog signal into digital signal and send the signal to the CPU.

2. The speed control device of a treadmill as claimed in claim 1, wherein the transmitter and the receiver are pivotally connected with a seat body fixed on a middle portion of the controlling panel, whereby the transmitter and the receiver have a certain pivot angle range so that the transmission and receiving of the transmitter and the receiver are limited to a certain height.

3. The speed control device of a treadmill as claimed in claim 1, wherein the treadmill includes a base seat and a tread platform, two upward extending columns being respectively disposed on two sides of the base seat, a handle being disposed at top end of each column, the controlling panel being mounted between the two handles, a front end of the tread platform being mounted between the two columns of the base seat, a tread belt being disposed in the tread platform, the tread belt being driven by a power source to circularly rotate.

4. The speed control device of a treadmill as claimed in claim 2, wherein the treadmill includes a base seat and a tread platform, two upward extending columns being respectively disposed on two sides of the base seat, a handle being disposed at top end of each column, the controlling panel being mounted between the two handles, a front end of the tread platform being mounted between the two columns of the base seat, a tread belt being disposed in the tread platform, the tread belt being driven by a power source to circularly rotate.

* * * * *